US009104168B2

(12) United States Patent
Gyotoku et al.

(10) Patent No.: US 9,104,168 B2
(45) Date of Patent: Aug. 11, 2015

(54) IMAGE FORMING APPARATUS

(71) Applicant: KYOCERA DOCUMENT SOLUTIONS INC., Osaka (JP)

(72) Inventors: Eiji Gyotoku, Osaka (JP); Masahito Ishino, Osaka (JP); Jun Nakai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/179,156

(22) Filed: Feb. 12, 2014

(65) Prior Publication Data

US 2014/0233977 A1 Aug. 21, 2014

(30) Foreign Application Priority Data

Feb. 15, 2013 (JP) ..... 2013-027993

(51) Int. Cl.
*G03G 21/20* (2006.01)
*G03G 21/06* (2006.01)

(52) U.S. Cl.
CPC ..... *G03G 21/06* (2013.01); *G03G 21/20* (2013.01)

(58) Field of Classification Search
CPC ..... G03G 21/20; G03G 15/751
USPC ..... 399/94, 96, 159
See application file for complete search history.

(56) References Cited

U.S. PATENT DOCUMENTS

| | | | | |
|---|---|---|---|---|
| 8,335,450 | B1 * | 12/2012 | Daloia et al. | 399/96 |
| 2006/0140663 | A1 * | 6/2006 | Matsuura | 399/96 |
| 2009/0052934 | A1 * | 2/2009 | Miyaji et al. | 399/96 |
| 2010/0232825 | A1 * | 9/2010 | Kakitani | 399/90 |

FOREIGN PATENT DOCUMENTS

JP 2007-264167 A 10/2007

* cited by examiner

*Primary Examiner* — Gregory H Curran
(74) *Attorney, Agent, or Firm* — Studebaker & Brackett PC

(57) ABSTRACT

An image forming apparatus includes an image bearing member, a developing unit, a cleaning unit, and a heating element. The heating element for heating the image bearing member includes: a substrate having a length corresponding to an entire region of the image bearing member in a longitudinal direction of the image bearing member; and a plurality of resistor chips mounted on the substrate. At least either resistance values or spacing intervals of the resistor chips vary in a longitudinal direction of the substrate to ensure that the surface temperature distribution of the image bearing member heated by the heating element is uniform.

11 Claims, 15 Drawing Sheets

IMAGE FORMING APPARATUS

INCORPORATION BY REFERENCE

The present application claims priority under 35 U.S.C. §119 to Japanese Patent Application No. 2013-027993, filed Feb. 15, 2013. The contents of this application are incorporated herein by reference in their entirety.

BACKGROUND

The present disclosure relates to image forming apparatuses, such as electrographic copiers, printers, and facsimile machines, as well as multifunction peripherals combining their functions.

Recent years, amorphous silicon (a-Si) photosensitive drums have been widely used as an image bearing member for an image forming apparatus utilizing an electrographic process. An a-Si photosensitive drum has high hardness and excellent durability, and its characteristics as a photosensitive member are substantially without degradation even after a prolonged usage. Therefore, high image quality can be maintained. That is to say, an a-Si photosensitive drum is an excellent image bearing member for its low running cost, easy handling characteristics, and high level of safety to the environment.

An image forming apparatus using such an a-Si photosensitive drum is known to involve a greater risk of image deletion owing to the characteristics of the a-Si photosensitive member. Image deletion refers to a phenomenon in which an image is blurred or smudged. Image deletion occurs when ion products adhere to the surface of the photosensitive drum and the ion products absorb moisture from the atmosphere. In particular, when the surface of the photosensitive drum is charged by a charging unit, nitrogen oxide (NOx) adheres to the surface of the photosensitive drum. The nitrogen oxide absorbs moisture, causing the latent charges to flow along the surface on which the latent image is formed. As a result, image deletion occurs in the electrostatic latent image formed on the surface of the photosensitive drum. Image deletion tends to occur especially at the edge portions of an electrostatic latent image.

Various methods have been suggested to reduce occurrence of image deletion. In one example, a heating element (heater) is provided inside the photosensitive drum, and a hygrothermograph sensor is provided inside the image forming apparatus. The heating element is heated based on the temperature and humidity measured by the hygrothermograph sensor. With this arrangement, even if moisture adheres to the surface of the photosensitive drum, the moisture can be evaporated. Consequently, occurrence of image deletion can be prevented.

Unfortunately, in the case where the heater is provided inside the photosensitive drum, a sliding electrode is required to connect the heater and the power supply. Therefore, there is a sliding portion connecting the heater to the power supply. As the total rotation time of the photosensitive drum is prolonged, connection failure may occur at the sliding portion.

In view of the above, a suggestion is made to provide the heating element in a static eliminating section. In particular, the static eliminating section includes a substrate, a light-emitting element, and a heating element. The light-emitting element is attached to one main surface of the substrate and emits light toward the photosensitive drum. The light irradiation by the light-emitting element eliminates the charges on the photosensitive drum. The heating element is disposed on the other main surface of the substrate. The heating element heats the photosensitive drum.

SUMMARY

An image forming apparatus according to one aspect of the present disclosure includes an image bearing member, a developing unit, a cleaning unit, and a heating element. The image bearing member includes a photosensitive layer. The developing unit forms a toner image by supplying a developing agent containing toner to the image bearing member to cause the toner to adhere to a surface of the image bearing member in conformity with an electrostatic latent image formed on the image bearing member. The cleaning unit removes residual toner from the surface of the image bearing member. The heating element heats the image bearing member. The heating element includes a substrate having a length corresponding to an entire region of the image bearing member in a longitudinal direction of the image bearing member, and a plurality of resistor chips mounted on the substrate. At least either resistance values or spacing intervals of the resistor chips vary in a longitudinal direction of the substrate, thereby causing the image bearing member to have a uniform temperature distribution when heated by the heating element.

DETAILED DESCRIPTION

The following describes embodiments of the present disclosure, with reference to the accompanying drawings. In the figures, the same or corresponding parts are denoted by the same reference sings, and a description of such parts is not repeated.

Figure 1:
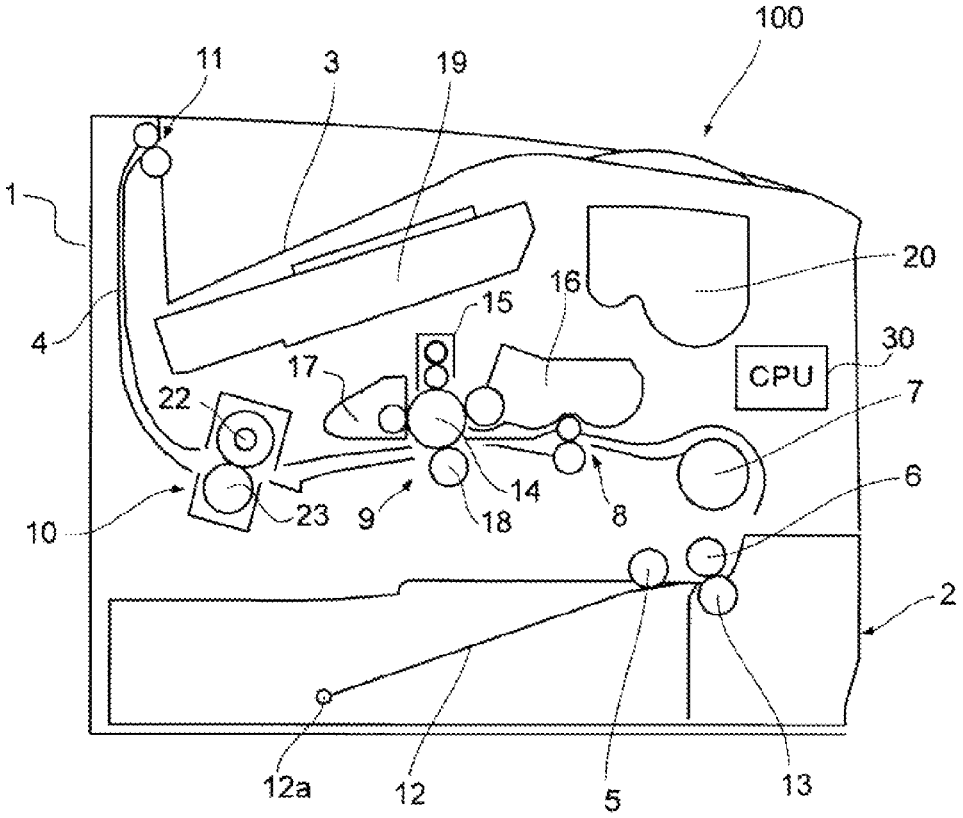
FIG. 1 is a schematic view showing an overall structure of an image forming apparatus according to a first embodiment.

FIG. 1 is a schematic view showing an overall structure of an image forming apparatus 100 according to a first embodiment. The right-hand side in FIG. 1 corresponds to the front side of the image forming apparatus 100. The image forming apparatus 100 is a monochrome printer. As shown in FIG. 1, the image forming apparatus 100 includes a sheet feed cassette 2. The sheet feed cassette 2 is provided at the bottom of a main body 1. The sheet feed cassette 2 stores a stack of sheets. Sheets are one example of a recording medium. Formed above the sheet feed cassette 2 is a sheet conveyance path 4. The sheet conveyance path 4 is one example of a recording medium conveyance path. The sheet conveyance path 4 extends generally horizontally from the front side to the rear side of the main body 1 and then extends upward to reach a sheet ejecting section 3. The sheet ejection section 3 is formed in the upper surface of the main body 1. Along the sheet conveyance path 4, the following are disposed in order from the upstream side in the sheet conveyance path 4: a pickup roller 5, a feed roller 6, an intermediate conveyance roller 7, a registration roller pair 8, an image forming section 9, a fixing unit 10, and an ejection roller pair 11. In addition, the image forming apparatus 100 includes a control section (CPU) 30. The control section 30 controls operation of the respective rollers stated above, the image forming section 9, and the fixing unit 10, and the like.

The sheet feed cassette 2 is provided with a sheet stacking plate 12. The sheet stacking plate 12 is supported to be freely pivotable about a pivotal fulcrum 12*a* relative to the sheet feed cassette 2. The pivotal fulcrum 12*a* is disposed on the rear edge in the sheet conveyance direction. Sheets are stacked on the sheet stacking plate 12. As the sheet stacking plate 12 pivots, the stack of sheets on the sheet stacking plate 12 comes to be pressed by the pickup roller 5. Disposed at a location forward of the sheet feed cassette 2 is a retard roller 13. The retard roller 13 is pressed against the feed roller 6. In the event that the pickup roller 5 simultaneously feeds a plurality of sheets, the sheets are separated by the feed roller 6 and the retard roller 13 so that only the topmost sheet is forwarded.

Having passed through the roller pair made up of the feed roller 6 and the retard roller 13, the sheet is conveyed to the intermediate conveyance roller 7. The intermediate conveyance roller 7 changes the sheet conveyance direction (the recording medium conveyance direction) from the direction toward the front side to the direction toward the rear side of the apparatus. Having passed the intermediate conveyance roller 7, the sheet is conveyed to the image forming section 9 via the registration roller pair 8. The registration roller pair 8 is provided for adjusting the timing for feeding the sheet to the image forming section 9.

The image forming section 9 forms a predetermined toner image on the sheet through an electrographic process. The image forming section 9 includes a photosensitive drum 14, which is one example of an image bearing member, a charging unit 15, a developing unit 16, a cleaning unit 17, a transfer roller 18, which is one example of a transfer member, and a laser scanning unit (LSU) 19. The photosensitive drum 14 is axially supported to be rotatable in the clockwise direction in FIG. 1. The charging unit 15, the developing unit 16, the cleaning unit 17, and the transfer roller 18 are disposed to surround the photosensitive drum 14. The transfer roller 18 is disposed to face the photosensitive drum 14 across the sheet conveyance path 4. The laser scanning unit (LSU) 19 is disposed above the photosensitive drum 14. In addition, a toner container 20 is disposed above the developing unit 16. The toner container 20 supplies toner to the developing unit 16.

In this embodiment, the photosensitive drum 14 is an amorphous silicon (a-Si) photosensitive member. The a-Si photosensitive drum includes a conductive substrate (tubular body) made, for example, of aluminum, an a-Si based photoconductive layer, and a surface protective layer. The a-Si based photoconductive layer is disposed as a photosensitive layer over the conductive substrate (tubular body). The surface protective layer is disposed on the upper surface of the photoconductive layer. The surface protective layer is made from an inorganic insulator or an inorganic semiconductor, such as a-Si based SiC, SiN, SiO, SiON, or SiCN.

When image data is input to the CPU 30 from a higher-level device, such as a personal computer, first, the charging unit 15 uniformly charges the surface of the photosensitive layer included in the photosensitive drum 14. Next, the laser scanning unit (LSU) 19 emits a laser beam based on the inputted image data so as to form an electrostatic latent image on the surface of the photosensitive layer included in the photosensitive drum 14. Then, the developing unit 16 supplies toner to the surface of the photosensitive drum 14. As a result, toner adheres to the surface of the photosensitive drum 14 in conformity with the electrostatic latent image. This forms a toner image on the surface of the photosensitive drum 14. The toner image is then transferred to the sheet fed to a nip portion (transfer position). The nip portion is formed at the contact point between the photosensitive drum 14 and the transfer roller 18. The sheet is fed to the nip portion by the transfer roller 18.

The sheet onto which the toner image has been transferred is separated from the photosensitive drum 14 and conveyed toward the fixing unit 10. The fixing unit 10 is disposed downstream from the image forming section 9 in the sheet conveyance direction. The fixing unit 10 includes a heating roller 22 and a pressure roller 23. The heating roller 22 is one example of a heating member, and the pressure roller 23 is one example of a pressure member. The pressure roller 23 is pressed against the heating roller 22. The sheet to which the toner image has been transferred is heated and pressed by the heating roller 22 and the pressure roller 23. As a result, the toner image transferred to the sheet is fixed. In the manner described above, an image is formed on the sheet by the image forming section 9 and the fixing unit 10. The sheet on which an image has been formed is ejected to the sheet ejecting section 3 by the ejection roller pair 11.

Note that some toner may remain on the surface of the photosensitive drum 14 even after the image transfer. The residual toner is removed by the cleaning unit 17. In addition, after the image transfer, a static eliminating unit 25 (see FIG. 2), which will be described later, eliminates the charges remaining on the surface of the photosensitive layer included in the photosensitive drum 14. Subsequently, the surface of the photosensitive layer included in the photosensitive drum 14 is again charged by the charging unit 15. Thereafter, image formation is performed in the same manner.

Figure 2:
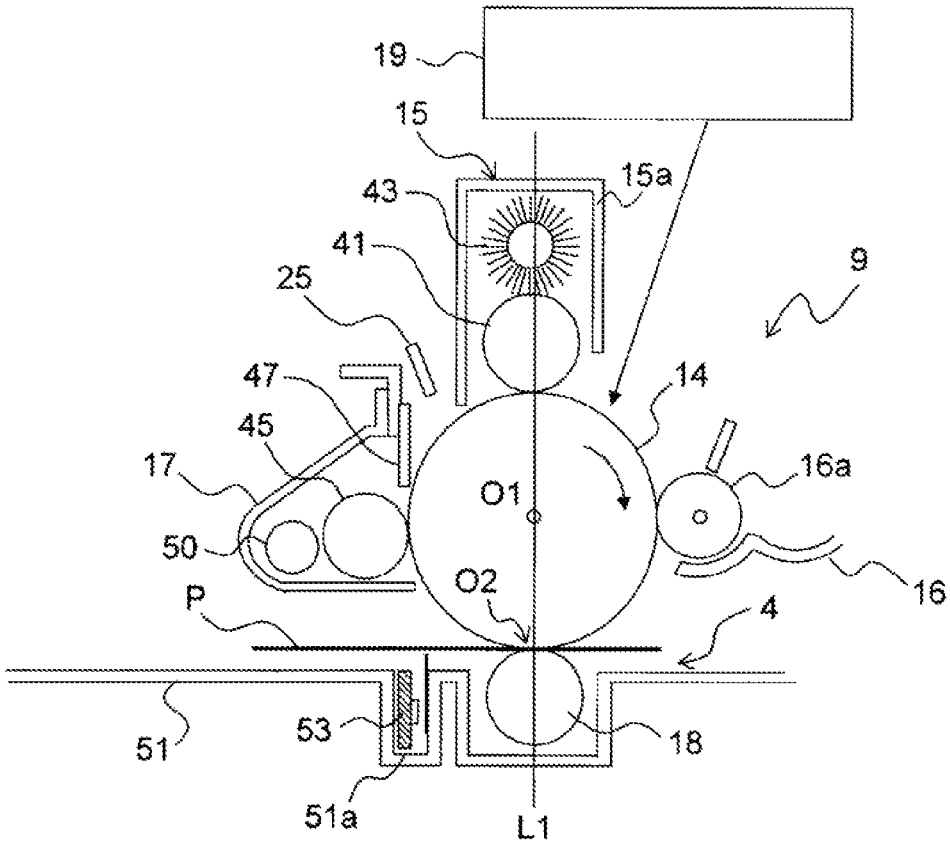
FIG. 2 is a schematic enlarged view showing a portion around an image forming section shown in FIG. 1.
Figure 3:
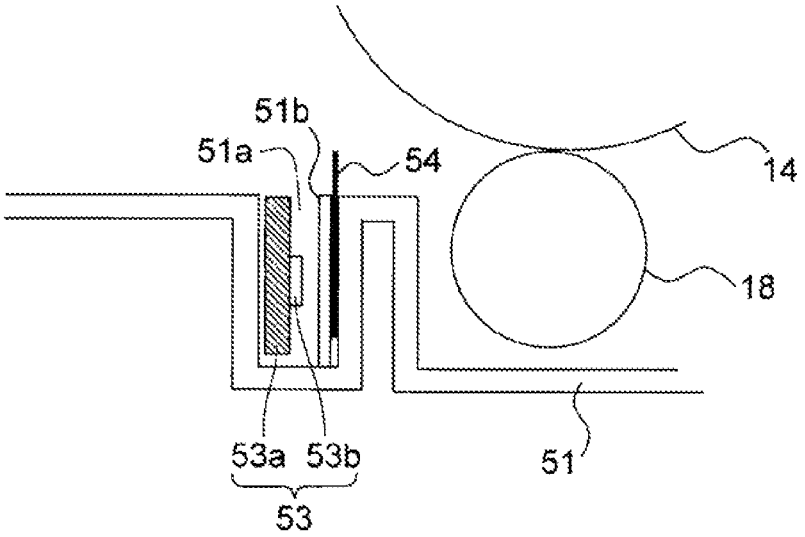
FIG. 3 is a schematic enlarged view showing a portion around a nip portion shown in FIG. 2.

FIG. 2 is a schematic enlarged view showing a portion around the image forming section 9 shown in FIG. 1, and FIG. 3 is a schematic enlarged view showing a portion around the nip portion shown in FIG. 2. The nip portion is formed at the contact point between the photosensitive drum 14 and the transfer roller 18. The charging unit 15 includes a charging housing 15*a*, a charging roller 41, and a charging-roller cleaning brush 43. The charging roller 41 and the charging-roller cleaning brush 43 are accommodated in the charging housing 15*a*. The charging roller 41 is in contact with the photosensitive drum 14 to apply a charging bias to the surface of the photosensitive drum 14. As a result, the surface of the photosensitive layer included in the photosensitive drum 14 is uniformly charged. The charging-roller cleaning brush 43 cleans the charging roller 41. The charging roller 41 is made of conductive rubber. The charging roller 41 is disposed to abut against the photosensitive drum 14. The charging-roller cleaning brush 43 is in contact with the charging roller 41.

As the photosensitive drum 14 rotates in the clockwise direction in FIG. 2, the charging roller 41 that is in contact with the surface of the photosensitive drum 14 is driven to rotate in the counterclockwise direction in FIG. 2. By applying a predetermined voltage to the charging roller 41 at this time, the surface of the photosensitive layer included in the photosensitive drum 14 is uniformly charged. In addition, as the charging roller 41 rotates, the charging-roller cleaning brush 43 that is in contact with the charging roller 41 is driven to rotate in the clockwise direction in FIG. 2. As a result, the charging-roller cleaning brush 43 removes foreign matter adhered on the surface of the charging roller 41.

The fixing unit 16 includes a developing roller 16*a*. The developing roller 16*a* is one example of a developing-agent bearing member. The developing roller 16*a* supplies toner to the surface of the photosensitive drum 14. The supplied toner adheres to the surface of the photosensitive drum 14 in conformity with the electrostatic latent image. To the developing unit 16, toner is supplied (fed) from the toner container 20 (see FIG. 1) via an intermediate hopper (not shown). In this embodiment, the toner contained in the developing unit 16 is a one-component developing agent. The one-component developing agent is made exclusively from a toner component having a magnetic property.

The cleaning unit 17 includes a slide-and-friction roller 45, a cleaning blade 47, and a toner collecting roller 50. The slide-and-friction roller 45 is one example of a polishing member. The slide-and-friction roller 45 is pressed against the photosensitive drum 14 at a predetermine pressure. In addition, the slide-and-friction roller 45 rotates in the counterclockwise direction shown in FIG. 2 by receiving power given by a drum cleaning motor (not shown). As a result, the slide-and-friction roller 45 rotates in the same direction as the rotation direction of the photosensitive drum 14 at the abutment surface with the photosensitive drum 14. At this time, the slide-and-friction roller 45 slides over the surface of the photosensitive drum 14. At this time, in addition, friction is produced between the slide-and-friction roller 45 and the photosensitive drum 14. In this way, the slide-and-friction roller 45 removes residual toner from the surface of the photosensitive drum 14 and at the same time polishes the surface of the photosensitive drum 14 (the surface of the surface protective layer) by using the residual toner. The toner supplied from the developing unit 16 is a polishing toner containing a polishing agent. The polishing toner adheres to the surface of the photosensitive drum 14 in conformity with the electrostatic latent image formed on the photosensitive drum 14. As a result, a toner image is formed. Further, the polishing toner remaining on the surface of the photosensitive drum 14 is used for polishing the surface of the photosensitive drum 14.

The linear velocity of the slide-and-friction roller 45 is higher than that of the photosensitive drum 14. For example, the linear velocity of the slide-and-friction roller 45 is 1.2 times higher than the linear velocity of the photosensitive drum 14. As an example of its structure, the slide-and-friction roller 45 may adopt a structure in which, for example, a roller body is wrapped around a metal shaft. A foam layer made of EPDM rubber having an Asker C hardness of 55° is usable as a martial of the roller body.

The material of the roller body is not limited to the EPDM rubber mentioned above. The roller body may be made of rubber or foam rubber of a different material. As the material of the roller body, one having an Asker C hardness ranging from 10° to 90° is suitably used. Note that Asker C is one of the durometers (spring type hardness meters) specified in the standard by the Society of Rubber Science and Technology, Japan. In short, Asker C is a device for measuring hardness (hardness meter). The Asker C hardness refers to a hardness measured by Asker C, and a greater value of Asker C hardness indicates material of higher hardness.

The cleaning blade 47 is disposed downstream from the slide-and-friction roller 45 in the rotation direction of the photosensitive drum 14 at the abutment surface between the slide-and-friction roller 45 and the photosensitive drum 14. The cleaning blade 47 is secured in abutment with the photosensitive drum 14. In one example of the cleaning blade 47, a blade made of polyurethane rubber having a JIS hardness of 78° is used. The cleaning blade 47 is secured so as to form a predetermined angle with the tangent to the surface of the photosensitive drum 14 at the point of abutment between the cleaning blade 47 and the photosensitive drum 14. The cleaning blade 47 removes toner remaining on the surface of the photosensitive drum 14 (residual toner) from the surface of the photosensitive drum 14. The material of the cleaning blade 47, the hardness of the cleaning blade 47, the dimensions of the cleaning blade 47, the amount by which the cleaning blade 47 bites into the photosensitive drum 14, the pressure under which the cleaning blade 47 is pressed against the photosensitive drum 14, and so on may be appropriately set according to the specifications of the photosensitive drum 14. Note that the JIS hardness refers to the hardness specified in the Japanese Industrial Standards (JIS).

The toner collecting roller 50 rotates in the clockwise direction in FIG. 2 while staying in contact with the surface of the slide-and-friction roller 45. By this action, the toner collecting roller 50 collects toner and the like adhered to the slide-and-friction roller 45. The toner and the like collected by the toner collecting roller 50 are then scraped off from the surface of the toner collecting roller 50 by a scraper (not shown). The residual toner removed from the surface of the photosensitive drum 14 by the cleaning blade 47 is ejected to the outside of the cleaning unit 17 by a collecting spiral (not shown). The toner and the like scraped off from the surface of the toner collecting roller 50 is similarly ejected to the outside of the cleaning unit 17 by the collecting spiral.

The transfer roller 18 transfers the toner image formed on the surface of the photosensitive drum 14 to the sheet P being conveyed along the sheet conveyance path 4, without disturbing the toner image. The transfer roller 18 is connected to a transfer bias supply and also to a bias control circuit (both not shown). By the transfer bias supply and the bias control circuit, a transfer bias which is of a reversed polarity to the toner is applied to the transfer roller 18.

The sheet conveyance path 4 has a conveyance surface that is formed by a conveyance-path resin member 51. A heating element 53 is disposed on the conveyance-path resin member 51. The heating element 53 heats the photosensitive drum 14. In FIG. 2, the contact point O2 is where the photosensitive drum 14 contacts the transfer roller 18. When L1 is defined as the straight line passing through the rotation center O1 of the photosensitive drum 14 and the contact point O2, the heating element 53 is located at the opposite side from the developing unit 16 across the straight line L1 (on the left-hand side of FIG. 2). In other words, the developing unit 16 is disposed upstream from the contact point O2 in the sheet conveyance direction, whereas the heating element 53 is disposed downstream from the contact point O2 in the sheet conveyance direction.

As described above, the heating element 53 that heats the photosensitive drum 14 is disposed outside the photosensitive drum 14. Therefore, a sliding electrode is no longer required to connect the heating element 53 to the power supply, and thus the risk of connection failure is eliminated. In addition, since the heating element 53 is disposed at the opposite side from the developing unit 16 across the straight line L1, heat generated by the heating element 53 is conducted less easily to the developing unit 16. This is effective to prevent precipitation and agglomeration of the toner in the developing unit 16.

In addition, the heating element 53 is accommodated in a concave portion 51*a* formed in the conveyance-path resin member 51. The concave portion 51*a* is located closer to the transfer roller 18 than to the photosensitive drum 14. Such disposition of the heating element 53 ensures that the heating element 53 does not obstruct the conveyance of the sheet P along the sheet conveyance path 4. Such disposition is also effective in that the heating element 53 is more distant from the cleaning unit 17. Thus, precipitation and agglomeration of the waste toner in the cleaning unit 17 can be prevented.

In addition, in the image forming apparatus 100 of a horizontal conveyance type as shown in FIG. 1, the heating element 53 is located below the photosensitive drum 14 (at the side of the transfer roller 18) across the sheet conveyance path 4 at all times. In this case, when the heating element 53 is conducted to warm up the ambient air, the warmed air travels upward by convection to arrive at the photosensitive drum 14. Therefore, the temperature of the photosensitive drum 14 is raised more efficiently as compared to the case where the heating element 53 is located above the transfer roller 18 (at the side of the photosensitive drum 14) across the sheet conveyance path 4.

Figure 4:
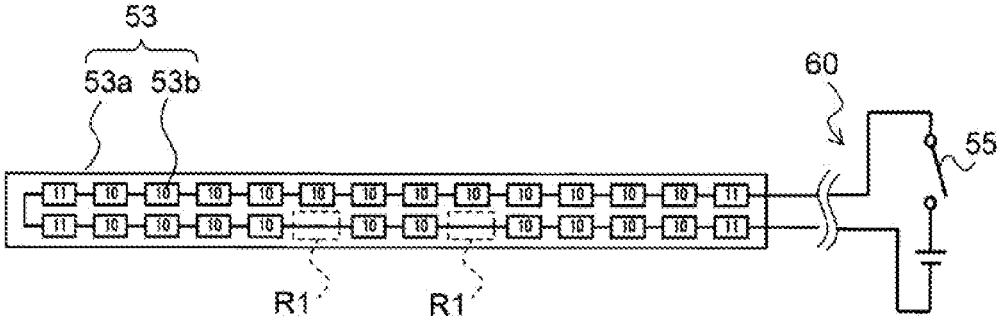
FIG. 4 is a plan view showing a structure of a heating element according to the first embodiment.

As shown in FIG. 3, the heating element 53 includes a substrate 53*a* and a plurality of resistor chips 53*b* (see FIG. 4). The plurality of resistor chips 53*b* are mounted on one main surface of the substrate 53*a* (the main surface on the right-hand side of FIG. 3). Hereinafter, the one main surface of the substrate 53*a* is referred to as the resistor-chip mounting surface. None of the resistor chips 53*b* is mounted on the other main surface of the substrate 53*a* (the main surface on the left-hand side of FIG. 3), the other main surface being the opposite side from the resistor-chip mounting surface. The heating element 53 is disposed such that the other main surface of the substrate 53*a* faces the first inner wall surface of the concave portion 51*a* opposite from the transfer roller 18 and that the resistor-chip mounting surface of the substrate 53*a* faces the second inner wall surface of the concave portion 51*a*, the second inner wall surface being closer toward the transfer roller 18. In addition, the resistor-chip mounting surface is disposed to have a predetermined gap from the second inner wall surface of the concave portion 51*a*. In this embodiment, a partition wall 51*b* is disposed to face the resistor-chip mounting surface, and a predetermined gap is secured between the resistor-chip mounting surface and the partition wall 51*b*.

In this way, the substrate 53*a* is located between the resistor chips 53*b* and the first inner wall surface of the concave portion 51*a*. Therefore, the temperature rise of the inner wall surfaces of the concave portion 51*a* is lessened. In addition, since the space is left between the resistor-chip mounting surface and the partition wall 51*b*, the air warmed by heat generated by the resistor chips 53*b* is assisted to flow toward the photosensitive drum 14 (upward in FIG. 3). The distance between the resistor-chip mounting surface and the partition wall 51*b* is preferably equal to the thickness of the substrate 53*a* (1.6 mm, in this case) or greater.

As shown in FIG. 3, a separation needle 54 is disposed downstream from the transfer roller 18 in the sheet conveyance direction (the direction from right to left in FIG. 2). The separation needle 54 is connected to a high-voltage supply (not shown). Therefore, the sheet P conveyed along the sheet conveyance path 4 is electrically attracted to the separation needle 54 and thus comes to be separated from the photosensitive drum 14. The separation needle 54 is secured to the second inner wall surface of the concave portion 51*a*. The partition wall 51*b* is disposed between the separation needle 54 and the heating element 53. This arrangement can prevent the heating element 53 from being damaged due to electric discharge from the separation needle 54 to the heating element 53.

FIG. 4 is a plan view showing a structure of the heating element 53. As stated above, the heating element 53 includes the substrate 53*a* and the plurality of resistor chips 53*b* disposed on the substrate 53*a*. The substrate 53*a* is longer in the axial direction of the photosensitive drum 14 (the direction perpendicular to the plane of FIG. 2). In FIG. 4, the numeral appended to each resistor chip 53*b* indicates the resistance value (Ω) of that resistor chip 53*b*. The temperature of the resistor chips 53*b* may rise nearly up to the heat-resistant temperature of synthetic resin. Therefore, for the substrate 53*a*, it is preferable to use a material having a low thermal conductivity, such as a glass epoxy resin (for example, CCL-EL190T manufactured by MITSUBISHI GAS CHEMICAL COMPANY, INC.). When the substrate 53*a* is formed from a material having a thermal conductivity lower than that of the conveyance-path resin member 51, heat of the resistor chips 53*b* is conducted less easily to the conveyance-path resin member 51 via the substrate 53*a*. As a result, the temperature rise of the conveyance-path resin member 51 is reduced. As the materials of the conveyance-path resin member 51 and the substrate 53*a*, examples satisfying the above conditions include: a polyphenylene sulfide (PPS) resin (for example, A310MX04 manufactured by Toray Industries, Inc. and having a thermal conductivity of 0.57 W/(m·k)) for the conveyance-path resin member 51, and a paper phenolic resin (for example, PLC-2147AQ manufactured by Sumitomo Bakelite Co., Ltd. and having a thermal conductivity of 0.25 W/(m·k)).

To prevent occurrence of image deletion on the photosensitive drum 14, it has been empirically confirmed that the relative humidity in the vicinity of the photosensitive drum 14 needs to be 60% or below. When the outside air temperature is from 10° C. to 40° C. and the relative humidity is 80%, keeping the relative humidity in the vicinity of the surface of the photosensitive drum 14 below 60% requires that the surface temperature of the photosensitive drum 14 be raised higher than the atmospheric temperature by 6° C. The output power of the heating element 53 required for raising the temperature by 6° C. or more is on the order of 1 W to 3 W.

In addition, the heating element 53 is connected to a power supply circuit 60. The power supply circuit 60 is provided with a switch 55 that can be turned on and off. The switch 55 turns off the conduction of electric current to the heating element 53 during the heating period (conduction period) of the heating roller 22 of the fixing unit 10 (see FIG. 1) and turns on the conduction of electric current to the heating element 53 during the non-heating period (non-conduction period) of the heating roller 22. This ensures to avoid concurrent heat generation by the heating roller 22 and the heating element 53. Therefore, excessive temperature rise in the image forming apparatus 100 can be prevented and power consumption can be saved. Note that the heating of the heating roller 22 is performed at the time of image forming and warm-up of the image forming apparatus 100.

The image forming apparatus 100 is provided with intake fans for drawing ambient air into the image forming apparatus 100 for cooling heating members, namely, the fixing unit 10, the laser scanning unit 19, and the like, disposed inside the image forming apparatus 100. According to the first embodiment, the intake fans (not shown) are disposed one on each of the opposing side surfaces (two side surfaces vertical to the plane of FIG. 1) of the image forming apparatus 100. Therefore, in the case where the resistor chips 53*b* having the same resistance value are evenly spaced in the longitudinal direction of the substrate 53*a*, the temperature of the photosensitive drum 14 tends to be lower at the edge portions, each of which is closer to a corresponding one of the intake fans, than at the central portion. This may result in a greater risk of image deletion at the edge portions and their neighboring portions of the photosensitive drum 14. The central portion of the photosensitive drum 14 refers to the portion that is located centrally in the longitudinal direction of the photosensitive drum 14, and the edge portions of the photosensitive drum 14 refer to the edge portions in the longitudinal direction of the photosensitive drum 14. The central portion of the photosensitive drum 14 thus refers to a region located inwardly from both the edge portions of the photosensitive drum 14.

In addition, in the case where the resistor chips 53*b* having the same resistance value are evenly spaced in the longitudinal direction of the substrate 53*a*, the heating element 53 involves the following possibility. That is, when the resistance value is determined to sufficiently raise the temperature of the edge portions of the photosensitive drum 14, the central portion of the photosensitive drum 14 may undergo an excessive temperature rise. In this case, the heat may cause precipitation and/or agglomeration of toner in the developing unit 16, which may risk that operation of the developing unit 16 to will be locked. Similarly, a risk may arise that the heat causes precipitation and/or agglomeration of toner in the cleaning unit 17, which may cause operation of the cleaning unit 17 to be locked.

In view of the above, the resistor chips 53*b* according to the first embodiment are disposed as shown in FIG. 4. In particular, twenty-two 10Ω resistor chips 53*b* are disposed in the longitudinal central portion of the substrate 53*a*, and two 11Ω resistor chips 53*b* are disposed in each longitudinal edge portion of the substrate 53*a*. That is, twenty-six resistor chips 53*b* are disposed in total. The power supply circuit 60 supplies 24 V direct voltage to the heating element 53. The central portion of the substrate 53*a* refers to a region located longitudinally inwardly from the respective edge portions of the substrate 53*a*. Hereinafter, the longitudinal central portion of the substrate 53*a* simply referred to as the central portion of the substrate 53*a*, whereas the longitudinal edge portions of the substrate 53*a* are simply referred to as the edge portions of the substrate 53*a*.

The amount of heat generation by the individual resistor chip 53*b* is proportional to the power consumption W. When I is defined as the electric current flowing upon application of the voltage E to the resistor chip 53*b* having a resistance value R, the power consumption W is given by the expression $W=EI$. According to the Ohm's law, $E=IR$, and thus $W=I^2R$ is given. From the above, it can be determined that the amount of heat generation by each resistor chip 53*b* is proportional to the resistance value R.

That is to say, the 11Ω resistor chips 53*b* disposed in the edge portions of the substrate 53*a* each generate more heat than that generated by the individual 10Ω resistor chips 53*b* disposed in the central portion of the substrate 53*a*. This arrangement achieves to more effectively heat the edge portions of the photosensitive drum 14. The edge portions tend to have a lower temperature as a result of exposure to the air flow produced by the intake fans. Consequently, the temperature rise variations across the photosensitive drum 14 in the longitudinal direction of the photosensitive drum 14 can be eliminated to reduce occurrence of image deletion.

The heating element 53 shown in FIG. 4 has regions R1 where none of the resistor chips 53*b* is disposed. The regions R1 are provided to reduce the increase in the total power consumption of the heating element 53 resulting from the inclusion of the 11Ω resistor chips 53*b*. That is, the regions R1 are secured in order to reduce the number of 10Ω resistor chips 53*b*. The amount of heat generation is lower in the regions R1 than in the other regions of the substrate 53*a*. Yet, the resistor chips 53*b* are omitted in locations corresponding to the central portion of the photosensitive drum 14, which are not likely to be affected by the temperature decrease caused by the air flow. Therefore, as will be described later, the presence of the regions R1 does not impose any great influence on the surface temperature of the photosensitive drum 14.

The applicability of the disposition of the resistor chips 53*b* as shown in FIG. 4 is not limited to the structure in which intake fans are disposed on the respective side surfaces of the image forming apparatus 100. The disposition of the resistor chips 53*b* as shown in FIG. 4 is likewise applicable to a structure in which an intake fan is disposed on one of the opposing side surfaces of the image forming apparatus 100 and an outlet is formed on the other side surface to allow the air flow to exit.

In addition, instead of disposing the resistor chips 53*b* to have varying resistance values in the longitudinal direction of the substrate 53*a*, it is applicable to vary the spacing intervals between the resistor chips 53*b* in the longitudinal direction of the substrate 53*a*. That is, the density of the resistor chips 53*b* may be made different from one location to another. In the first embodiment, the resistor chips 53*b* may be disposed with a smaller spacing interval at the edge portions of the substrate 53*a* than at the central portion of the substrates 53*a*. This arrangement achieves to more effectively heat the edge portions of the photosensitive drum 14.

Preferably, the conveyance-path resin member 51 is made from a material having a relative temperature index (hereinafter, RTI) greater than the surface temperature of the heating element 53. The RTI is an index of degradation of the mechanical characteristics (tensile strength and tensile impact strength) and the electrical characteristics (disruptive strength) after prolonged use in an environment associated with exposure to high temperature. The RTI is defined based on UL 746B (the UL Standard for Safety for Polymeric Materials—Long Term Property Evaluations) by Underwriters Laboratories Inc. in the United States of America. For example, a resin having an RTI of 110 means that the resin will have 50% of the initial mechanical characteristics and of the initial electrical characteristics after a 100,000-hour exposure at 110° C. Thus, by keeping the surface temperature of the heating element 53 below the RTI of the conveyance-path resin member 51, the mechanical characteristics and the electrical characteristics of the conveyance-path resin member 51 can be maintained until the end of the useful life of the image forming apparatus 100.

In addition to the polyphenylene sulfide resin mentioned above, examples of the material usable for the conveyance-path resin member 51 include modified-polyphenyleneether (m-PPE) (for example, Xyron SZ800 manufactured by Asahi Kasei Chemicals Corporation).

In addition, the heating element 53 is not conducted at the time of power-up of the image forming apparatus 100. When the conduction of electric current to the heating element 53 is turned on simultaneously with the power-up, the output power of the heating element 53 is low and requires three to four hours until the surface temperature of the photosensitive drum 14 is raised by 6° C. Therefore, when image formation is performed immediately after the power-up under the condition that the relative humidity inside the image forming apparatus 100 is 60% or higher, image deletion may occur. To prevent such occurrence of image deletion, it is preferable to perform drum refresh immediately after the power-up.

The following is an example of a specific method for the drum refresh. First, toner is ejected toward the photosensitive drum 14 from the developing roller 16*a* included in the developing unit 16. Then, the photosensitive drum 14 and the slide-and-friction roller 45 rotate for a predetermined period of time. Consequently, the surface of the photosensitive drum 14 (the surface of the surface protective layer) is polished by the toner present between the photosensitive drum 14 and the slide-and-friction roller 45.

Figure 5:
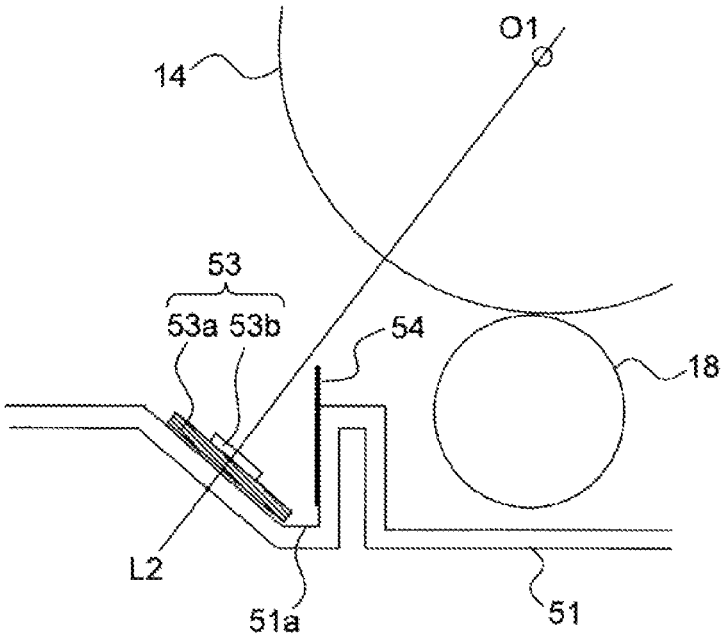
FIG. 5 is a view showing another example of the disposition of the heating element according to the first embodiment.

FIG. 5 is view showing another disposition of the heating element 53. FIG. 5 shows, on an enlarged scale, a portion around the nip portion that is formed at the contact point between the photosensitive drum 14 and the transfer roller 18. In FIG. 5, the first inner wall surface of the concave portion 51*a* facing the substrate 53*a* of the heating element 53 (the first inner wall surface positioned at the downstream side in the sheet conveyance direction) is an inclined surface. The inclined surface is sloped such that a straight line L2 perpendicular to the inclined surface passes though the rotation center O1 of the photosensitive drum 14. Consequently, the substrate 53*a* is located at a position that would be projected on the surface of the photosensitive drum 14. The substrate 53*a* of the heating element 53 is disposed along the inclined surface.

With this structure, the photosensitive drum 14 is heated by convection of air warmed by the heating element 53 and also directly by radiant heat from the resistor chips 53*b*. Thus, the photosensitive drum 14 is more efficiently heated as compared to the disposition of the heating element 53 shown in FIG. 2. Further, since the gap between the heating element 53 and the separation needle 54 is wider, electric discharge from the separation needle 54 to the heating element 53 is reduced.

Figure 6:
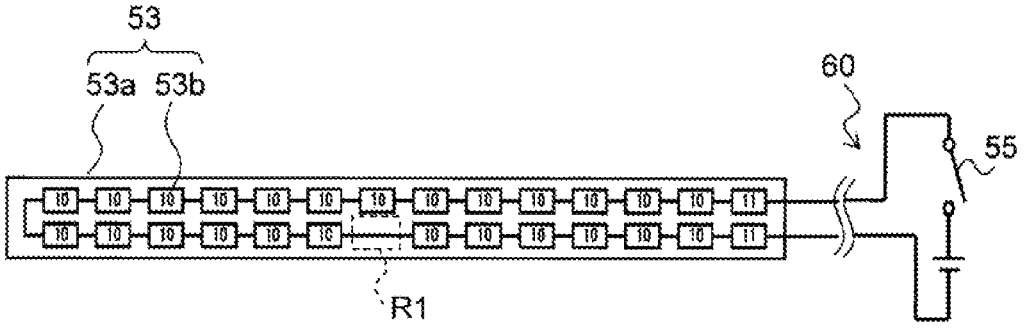
FIG. 6 is a plan view showing a structure of a heating element according to a second embodiment.

FIG. 6 is a plan view showing a structure of a heating element 53 included in an image forming apparatus 100 according to a second embodiment. With reference to FIG. 6, the following describes where the second embodiment differs from the first embodiment.

For cooling the heating members disposed inside the image forming apparatus 100, the image forming apparatus 100 according to the second embodiment is provided with an intake fan (not shown) for drawing ambient air into the image forming apparatus 100. The intake fan is disposed on one of the opposing side surfaces (the side surface further back in FIG. 1) of the image forming apparatus 100. Therefore, in the case where the resistor chips 53*b* having the same resistance value are evenly spaced in the longitudinal direction of the substrate 53*a*, the temperature of the photosensitive drum 14 tends to be lower at the one edge portion located closer to the intake fan than at the central portion and the other edge portion of the photosensitive drum 14. This may increase the risk of image deletion at the one edge portion and its neighboring portion of the photosensitive drum 14.

In view of the above, the resistor chips 53*b* according to the second embodiment are disposed as shown in FIG. 6. In particular, two 11Ω resistor chips 53*b* are disposed in the one edge portion of the substrate 53*a*, and twenty five 10Ω resistor chips 53*b* are disposed in the other portion, namely the central portion and the other edge portion, of the substrate 53*a*. The power supply circuit 60 supplies 24 V direct voltage to the heating element 53.

That is to say, the 11Ω resistor chips 53*b* disposed in the one edge portions of the substrate 53*a* each generate more heat than that generated by the individual 10Ω resistor chips 53*b* disposed in the central portion and the other edge portion of the substrate 53*a*. This arrangement achieves to more effectively heat the one edge portion of the photosensitive drum 14 (the end portion further back in FIG. 1). The one edge portion tends to have a lower temperature as a result of exposure to the air flow produced by the intake fan. Consequently, the temperature rise variations across the photosensitive drum 14 in the longitudinal direction of the photosensitive drum 14 can be eliminated to reduce occurrence of image deletion.

Similarly to the heating element 53 shown in FIG. 4, the heating element 53 shown in FIG. 6 also has a region R1 where none of the resistor chips 53*b* is disposed. In particular, the region R1 is provided at a location corresponding to the central portion of the photosensitive drum 14 in order to reduce the increase in the total power consumption of the heating element 53 resulting from the inclusion of the 11Ω resistor chips 53*b*.

Figure 7:
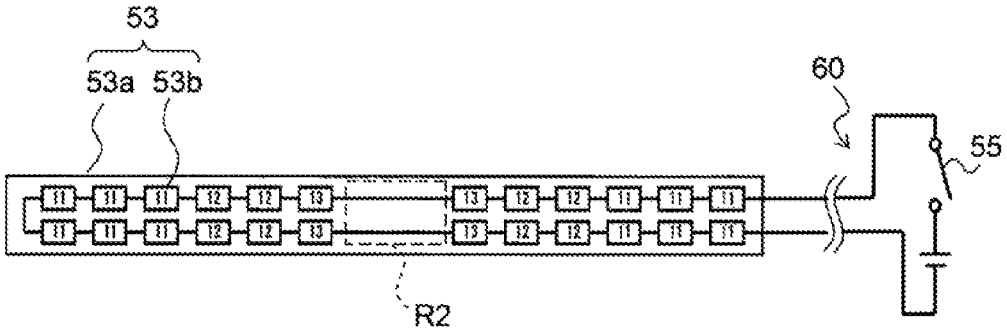
FIG. 7 is a plan view showing a structure of a heating element according to a third embodiment.

FIG. 7 is a plan view showing a structure of a heating element 53 included in an image forming apparatus 100 according to a third embodiment. With reference to FIG. 7, the following describes where the third embodiment differs from the first embodiment.

The image forming apparatus 100 according to the third embodiment includes a retaining member (not shown) for retaining the heating element 53 within a concave portion 51*a* of a conveyance-path resin member 51. The retaining member is attached to a region R2 located at the central portion of the substrate 53*a*. Therefore, none of the resistor chips 53*b* can be mounted in the region R2 of the substrate 53*a*. As a result, the temperature of the photosensitive drum 14 tends to be lower at the central portion corresponding to the region R2 than at the edge portions of the photosensitive drum 14, which may increase a risk of image deletion at the central portion of the photosensitive drum 14.

In view of the above, the resistor chips 53*b* according to the third embodiment are disposed as shown in FIG. 7. In particular, two 13Ω resistor chips 53*b* are disposed just outside either side of the region R2 of the substrate 53*a*, four 12Ω resistor chips 53*b* are disposed just outside each region where the two 13Ω resistor chips 53*b* are disposed, and six 11Ω resistor chips 53*b* are disposed just outside each region where the four 12Ω resistor chips 53*b* are disposed. The power supply circuit 60 supplies 24 V direct voltage to the heating element 53.

That is, the resistance values of the resistor chips 53*b* are gradually higher from the edge portions of the substrate 53*a* toward the central portion of the substrate 53*a*. Consequently, the amount of heat generation by the resistor chips 53*b* increases from the edge portions of the substrate 53*a* to the central portion of the substrate 53*a*. This achieves to more effectively heat the region of the photosensitive drum 14 corresponding to the region R2 where none of the resistor chips 53*b* can be disposed. Consequently, the temperature rise variations across the photosensitive drum 14 in the longitudinal direction of the photosensitive drum 14 can be eliminated to reduce occurrence of image deletion.

Figure 8:
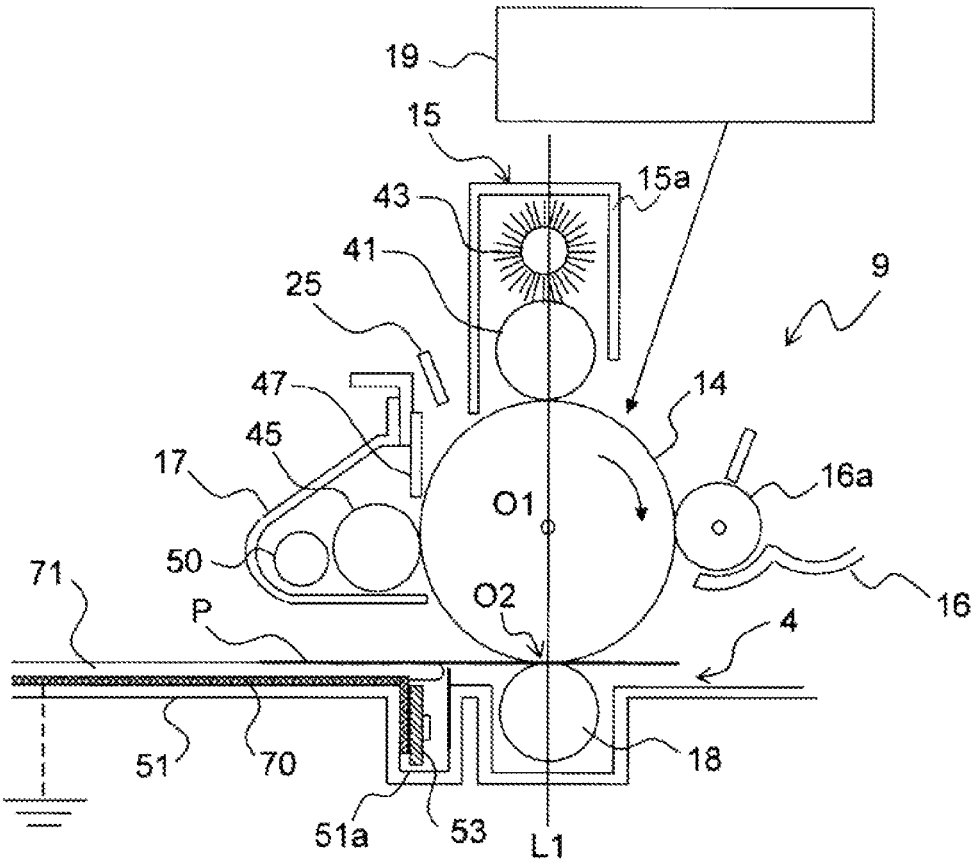
FIG. 8 is a schematic enlarged view showing a portion around an image forming section according to a fourth embodiment.
Figure 9:
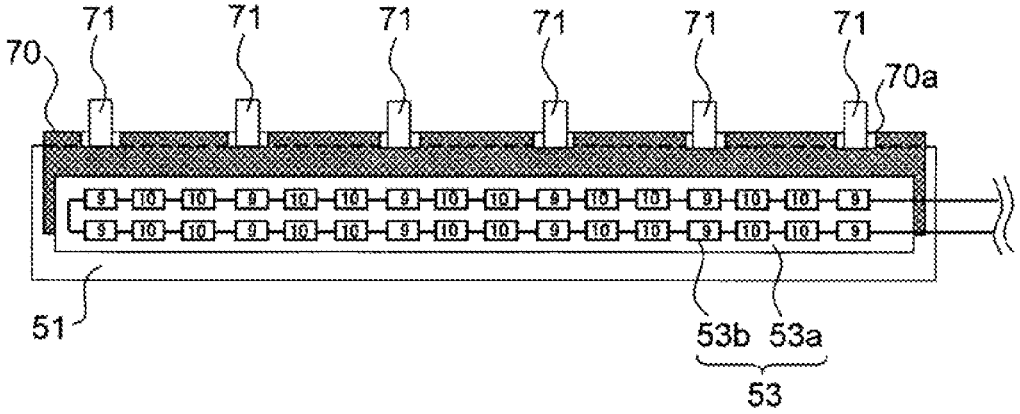
FIG. 9 is a view showing a heating element and a conveyance metal plate according to the fourth embodiment.
Figure 10:
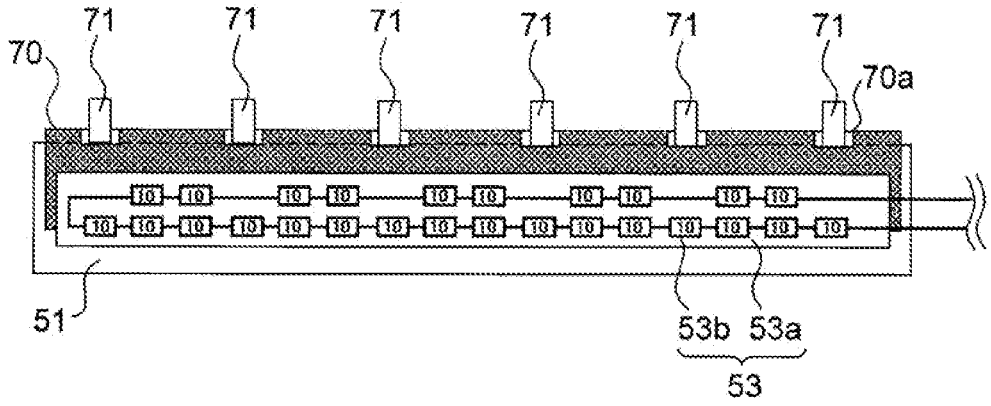
FIG. 10 is a view showing another structure of the heating element and the conveyance metal plate according to the fourth embodiment.

FIG. 8 is a schematic enlarged view showing a portion surrounding an image forming section 9 of an image forming apparatus 100 according to a fourth embodiment. FIG. 9 is a view showing a heating element 53 and a conveyance metal plate 70 included the image forming apparatus 100 according to the fourth embodiment. FIG. 9 shows the heating element 53 and the conveyance metal plate 70 as viewed from the right direction of FIG. 8. With reference to FIGS. 8 and 9, the following describes where the fourth embodiment differs from the first embodiment.

As shown in FIG. 8, the conveyance metal plate 70 extends along the conveyance-path resin member 51 from the first inner wall surface of the concave portion 51*a* that is positioned at the downstream side in the sheet conveyance direction (the inner wall surface on the left-hand side of FIG. 8) to a downstream position in the sheet conveyance direction. In addition, the conveyance-path resin member 51 is provided with a plurality of ribs 71. The ribs 71 protrude beyond the surface of the conveyance metal plate 70.

As shown in FIG. 9, the conveyance metal plate 70 has a plurality of (6, in this embodiment) openings 70*a* in a portion along the sheet conveyance direction. Each opening 70*a* is elongated in the sheet conveyance direction. The plurality of (6, in this example) ribs 71 are formed integrally with the conveyance-path resin member 51 on its surface along the sheet conveyance direction (top surface). Each rib 71 protrudes into the sheet conveyance path 4 through a corresponding one of the openings 70*a*. In addition, the substrate 53*a*, which is a component of the heating element 53, is secured to a portion of the conveyance metal plate 70, the portion extending along the concave portion 51*a*. More specifically, the substrate 53*a* is secured to the conveyance metal plate 70 at the main surface of the substrate 53*a* on which the resistor chips 53*b* are not mounted, the main surface being the opposite side from the resistor-chip mounting surface.

In the fourth embodiment, the sheet P is charged by the transfer bias applied to the transfer roller 18 and thus electrically attracted to the conveyance metal plate 70 that is disposed on the upper surface of the conveyance-path resin member 51. This ensures that the sheet P is attracted toward the upper surface of the conveyance-path resin member 51 and thus smoothly conveyed along the conveyance-path resin member 51. Each rib 71 is disposed on the top surface of the conveyance-path resin member 51 and protrudes beyond the surface of the conveyance metal plate 70. This arrangement keeps the sheet P out of direct contact with the conveyance metal plate 70 and eliminates the risk of bias current flowing into the conveyance metal plate 70.

In addition, the conveyance metal plate 70 is formed from a material having a higher thermal conductivity than that of the conveyance-path resin member 51, and the substrate 53*a* of the heating element 53 is secured to the conveyance metal plate 70. Examples of the usable materials include: an electrolytic zinc-coated steel sheet (SECC) manufactured by Sumitomo Metal Industries, Ltd. and having a thermal conductivity of 50.0 W/(m·k) for the conveyance metal plate 70; Xyron SZ800 manufactured by Asahi Kasei Chemicals Corporation and having a thermal conductivity from 0.16 W/(m·k) to 0.20 W/(m·k)) for the conveyance-path resin member 51; and CCL-EL190T manufactured by MITSUBISHI GAS CHEMICAL COMPANY, INC. and having a thermal conductivity of 0.45 W/(m·k) for the substrate 53*a*.

Use of such materials enables the conveyance metal plate 70 to function as a heat-dissipating plate (heat sink), so that the conveyance metal plate 70 efficiently dissipates heat conducted from the resistor chips 53*b* to the substrate 53*a*. Thus, deterioration and damage of the substrate 53*a* by heat can be reduced.

As shown in FIG. 8, in addition, the ribs 71 extend into a region above the concave portion 51*a*. That is to say, the ribs 71 are present between the heating element 53 and the photosensitive drum 14. Consequently, the photosensitive drum 14 receives heat from the heating element 53, and also receives heat from the ribs 71 that are heated by the heating element 53. As a result, the surface temperature of the photosensitive drum 14 tends to be higher at the surface region corresponding to the ribs 71 than at the other surface regions.

In view of the above, the resistor chips 53*b* according to the fourth embodiment are disposed as shown in FIG. 9. In particular, two 9Ω resistor chips 53*b* are disposed in each of six locations along the longitudinal direction of the substrate 53*a* (regions corresponding to the ribs 71), which means that twelve 9Ω resistor chips 53*b* are disposed in total. In addition, twenty 10Ω resistor chips 53*b* are disposed at the other locations. This arrangement reduces the heat applied to the photosensitive drum 14 at the surface regions thereof corresponding to the ribs 71. Consequently, the temperature rise variations across the photosensitive drum 14 in the longitudinal direction of the photosensitive drum 14 can be eliminated to reduce occurrence of image deletion.

Alternatively, a fewer number of resistor chips 53*b* may be disposed in the regions corresponding to the ribs 71. In this way, the temperature rise variations across the photosensitive drum 14 in the longitudinal direction of the photosensitive drum 14 may likewise be eliminated by varying the spacing intervals of the resistor chips 53*b*.

The present disclosure is not limited to the first to fourth embodiments described above, and various modifications are possible within a scope not departing from the gist of the present disclosure. For example, according to the first to fourth embodiments, either the resistance values or the spacing intervals of the resistor chips 53*b* are varied along the longitudinal direction of the substrate 53*a*. Alternatively, both the resistance values and the spacing intervals of the resistor chips 53*b* can be varied along the longitudinal direction of the substrate 53*a*.

In addition, alternatively to the charging unit 15 of a contact charging type that includes the charging roller 41 as shown in FIG. 2, a charging unit of a corona charging type may be used. The charging unit of a corona charging type includes a corona wire and a grid. In addition, alternatively to the developing unit 16 of a one-component development type, a developing unit of a two-component development type may be used. The developing unit of a two-component development type uses a two-component developing agent containing toner and magnetic carrier.

In addition, the image forming apparatus according to the present disclosure is not limited to a monochrome printer as shown in FIG. 1. Alternatively, the present disclosure may be applicable to any other image forming apparatuses, such as monochrome copiers, color copiers, digital multifunctional peripherals, color printers, facsimile machines, and so on.

In the image forming apparatus 100 according to the first to fourth embodiments described above, the heating element 53 for heating the photosensitive drum 14 includes the substrate 53*a* and the plurality of resistor chips 53*b* mounted on the substrate 53*a*. The substrate 53*a* extends correspondingly to the entire region of the photosensitive drum 14 in the longitudinal direction of the photosensitive drum 14. To ensure that the photosensitive drum 14 is heated by the heating element 53 to have a uniform surface temperature distribution, the resistor chips 53*b* are disposed so that at least either the resistance values or the spacing intervals of the resistor chips 53*b* varies along the longitudinal direction of the substrate 53*a*. With this arrangement, the temperature rise variations across the photosensitive drum 14 in the longitudinal direction of the photosensitive drum 14 can be efficiently eliminated to reduce occurrence of image deletion. This is achieved even when an air flow is present around the photosensitive drum 14 or a region of the substrate 53*a* is used for retaining the substrate 53*a* and thus not available for mounting a resistor chip.

The following specifically describes advantageous effects of the present disclosure by way of examples.

Example 1

Figure 11:
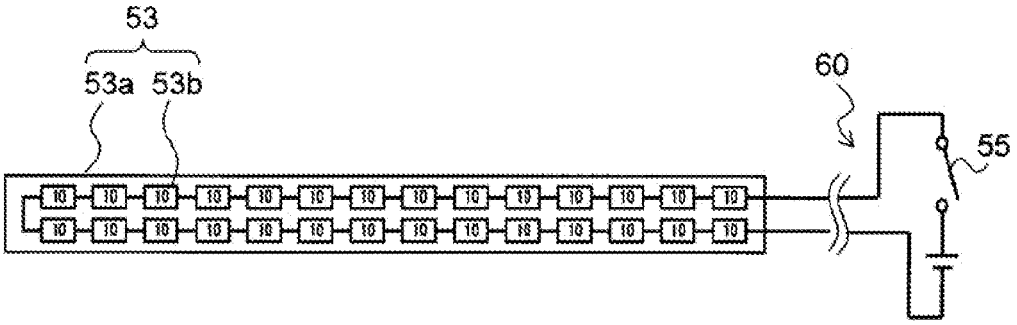
FIG. 11 is a plan view showing a structure of a heating element included in an image forming apparatus of Comparative Examples 1 and 2.

As Example 1, an image forming apparatus 100 was prepared which was provided with intake fans one on each side surface of the image forming apparatus 100 (one at the front and the other at the rear) facing the respective edge portions of a photosensitive drum 14. The image forming apparatus 100 of Example 1 includes the heating element 53 shown in FIG. 4. That is, twenty-two 10Ω resistor chips 53*b* were disposed in the central portion of the substrate 53*a*, and two 11Ω resistor chips 53*b* were disposed in each of the two edge portions of the substrate 53*a*. In the image forming apparatus 100 of Example 1, the photosensitive drum 14 was heated by the heating element 53. The surface temperature of the photosensitive drum 14 thus heated was measured (Test 1). As Comparative Example 1, an image forming apparatus 100 was prepared, with the only difference from Example 1 residing in the structure of the heating element 53. FIG. 11 is a plan view showing the structure of the heating element 53 included in the image forming apparatus 100 of Comparative Example 1. As shown in FIG. 11, twenty-eight 10Ω resistor chips 53*b* were evenly spaced along the longitudinal direction of the substrate 53*a*. In the image forming apparatus 100 of Comparative Example 1, the photosensitive drum 14 was heated by the heating element 53. The surface temperature of the photosensitive drum 14 thus heated was measured (Test 2).

Tests 1 and 2 were conducted under the same testing conditions. In particular, the respective image forming apparatuses 100 were installed in a room with a temperature of 25° C. The target temperature for raising the surface temperature of the photosensitive drum was set to 31° C. The direct voltage of 24 V was applied to the heating element 53. The surface temperature of the photosensitive drum 14 was measured at locations A-E in the respective regions determined by equally dividing the photosensitive drum 14 in the direction from the front to the rear of the image forming apparatus 100 (in FIG. 4, from the left to the right of the heating element 53). The test results are shown in FIG. 12.

Figure 12:
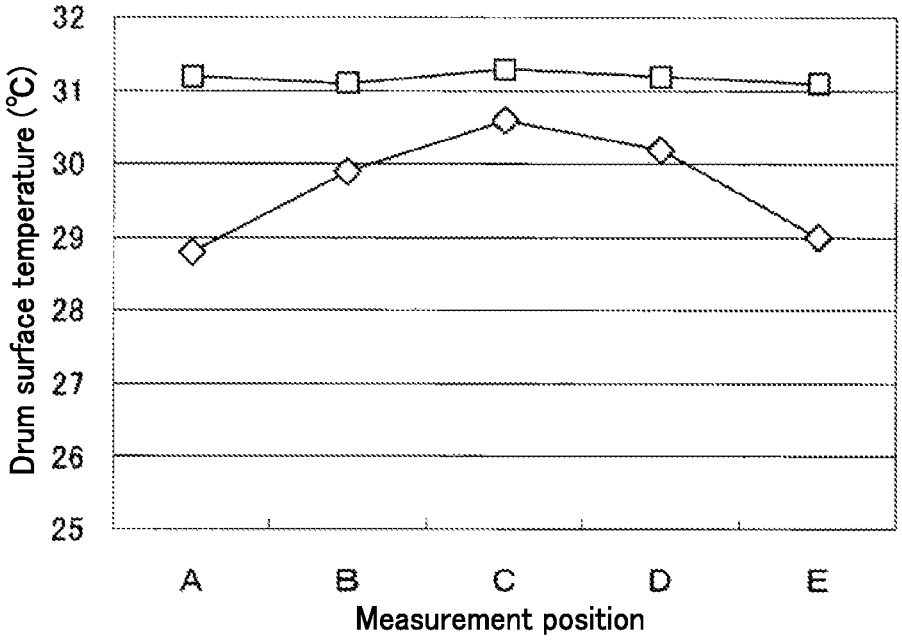
FIG. 12 is a graph showing measurement results of Tests 1 and 2.

In FIG. 12, a data sequence plotted with the symbol □ (white square) indicates the results of Test 1, whereas a data sequence plotted with the symbol ◇ (white diamond) indicates the result of Test 2. As FIG. 12 clarifies, the surface temperature of the photosensitive drum 14 in Test 1 (the data sequence with □ (white square)) was 31° C. at all the measurement locations A-E. This confirms that by disposing the resistor chips 53*b* having a higher resistance value (11Ω) in each edge portion of the substrate 53*a*, the photosensitive drum 14 was heated uniformly across its longitudinal direction. In contrast, Test 2 (the data sequence with ◇ (white diamond)) indicates that the surface temperature of the photosensitive drum 14 fell below the target temperature of 31° C. at the measurement locations closer to the edge portions of the photosensitive drum 14 as a result of disposing the resistor chips 53*b* all having the same resistance value (10Ω).

In addition, the value of the electric current flowing through the heating element 53 of the image forming apparatus 100 was 0.0909 A in Example 1 and 0.0857 A in that of Comparative Example 1. It follows that the power consumption W of the heating element 53 of Example 1 is calculated to be $W=I^2R=(0.0909)^2\times\{(10\times22)+(11\times4)\}=(0.0909)^2\times264$ 2.181 W. On the other hand, the power consumption W of the heating element 53 of Comparative Example 1 is calculated to be $W=I^2R=(0.0857)^2\times(10\times28)$ 2.056 W. It means that there was no substantial difference in the power consumption between the image forming apparatus 100 of Example 1 and the image forming apparatus 100 of Comparative Example 1.

Example 2

As Example 2, an image forming apparatus 100 was prepared which was provided with an intake fan on one side surface (one at the rear) facing one edge portion of a photosensitive drum 14. The image forming apparatus 100 of Example 2 includes the heating element 53 shown in FIG. 6. That is, two 11Ω resistor chips 53*b* were disposed in the one edge portion of the substrate 53*a* (the edge portion closer to the rear) and twenty-five 10Ω resistor chips 53*b* were disposed in the other portion, namely in the central portion and the other edge portion (the edge portion closer to the front) of the substrate 53*a*. In the image forming apparatus 100 of Example 2, the photosensitive drum 14 was heated by the heating element 53. The surface temperature of the photosensitive drum 14 thus heated was measured (Test 3). As Comparative Example 2, an image forming apparatus 100 was prepared, with the only difference from Example 2 residing in the structure of the heating element 53. In particular, similarly to Comparative Example 1, the image forming apparatus 100 of Comparative Example 2 includes the heating element 53 shown in FIG. 11. That is, twenty-eight 10Ω resistor chips 53*b* were evenly spaced along the longitudinal direction of the substrate 53*a*. In the image forming apparatus 100 of Comparative Example 2, the photosensitive drum 14 was heated by the heating element 53. The surface temperature of the photosensitive drum 14 thus heated was measured (Test 4). The measurement conditions and the measurement locations of the surface temperature of the photosensitive drum 14 were the same as those employed in Tests 1 and 2. The test results are shown in FIG. 13.

Figure 13:
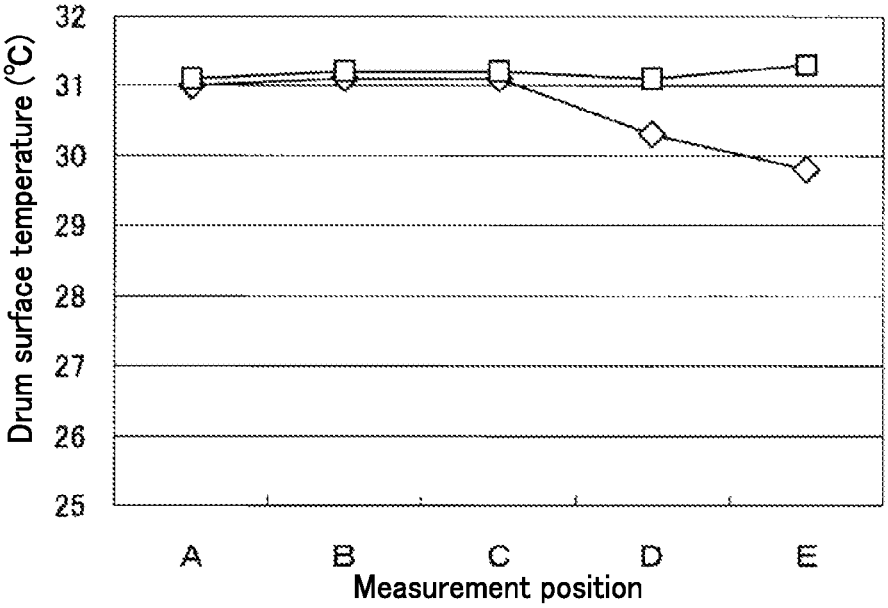
FIG. 13 is a graph showing measurement results of Tests 3 and 4.

In FIG. 13, a data sequence plotted with the symbol □ (white square) indicates the results of Test 3, whereas a data sequence plotted with the symbol ◇ (white diamond) indicates the result of Test 4. As FIG. 13 clarifies, the surface temperature of the photosensitive drum 14 in Test 3 (the data sequence with □ (white square)) was 31° C. at all the measurement locations A-E. This confirms that by disposing the resistor chips 53*b* having a higher resistance value (11Ω) at the one edge portion of the substrate 53*a* (the edge portion closer to the rear), the photosensitive drum 14 was heated uniformly across its longitudinal direction. In contrast, Test 4 (the data sequence with ◇ (white diamond)) indicates that the surface temperature of the photosensitive drum 14 fell below the target temperature of 31° C. at the measurement locations closer to the one edge portion of the photosensitive drum 14 (the edge portion closer to the rear) as a result of providing the resistor chips 53*b* all having the same resistance value (10Ω).

In addition, the value of the electric current flowing through the heating element 53 of the image forming apparatus 100 was 0.0882 A in Example 2. It follows that the power consumption W of the heating element 53 of Example 2 is calculated to be $W=I^2R=(0.0882)^2\times\{(10\times25)+(11\times2)\}=$ $(0.0882)^2 \times 272 \approx 2.116$ W. On the other hand, the power consumption W of the heating element 53 of Comparative Example 2 was 2.056 W, which is the same as Comparative Example 1. It means that there was no substantial difference in the power consumption between the image forming apparatus 100 of Example 2 and the image forming apparatus 100 of Comparative Example 2.

Example 3

Figure 14:
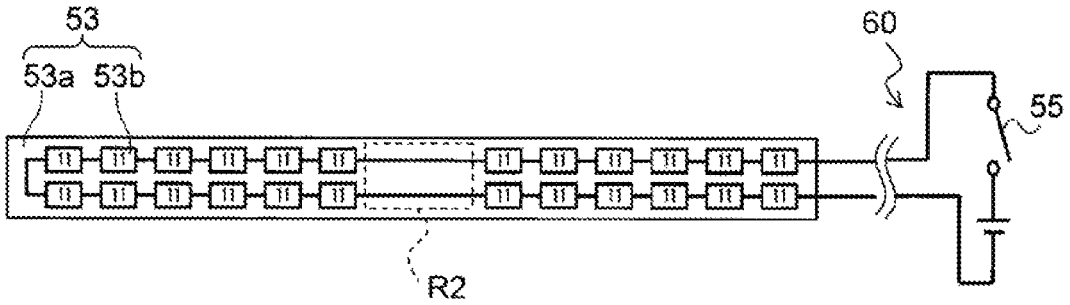
FIG. 14 is a plan view showing a structure of a heating element included in an image forming apparatus of Comparative Example 3.

As Example 3, an image forming apparatus 100 was prepared which includes a retaining member for retaining the heating element 53. The retaining member was attached to the region R2 in the central portion of the substrate 53*a*. The image forming apparatus 100 of Example 3 includes the heating element 53 shown in FIG. 7. That is, two 13Ω resistor chips 53*b* were disposed just outside the either side of the region R2 of the substrate 53*a*, four 12Ω resistor chips 53*b* were disposed just outside each region where the two 13Ω resistor chips 53*b* were disposed, and six 11Ω resistor chips 53*b* were disposed just outside each region where the four 12Ω resistor chips 53*b* were disposed. In the image forming apparatus 100 of Example 3, the photosensitive drum 14 was heated by the heating element 53. The surface temperature of the photosensitive drum 14 thus heated was measured (Test 5). As Comparative Example 3, an image forming apparatus 100 was prepared, with the only difference from Example 3 residing in the structure of the heating element 53. FIG. 14 is a plan view showing the structure of the heating element 53 included in the image forming apparatus 100 of Comparative Example 3. As shown in FIG. 14, twenty-four 11Ω resistor chips 53*b* were evenly spaced on the substrate 53*a* along the longitudinal direction of the substrate 53*a* except in the region R2. In the image forming apparatus 100 of Comparative Example 3, the photosensitive drum 14 was heated by the heating element 53. The surface temperature of the photosensitive drum 14 thus heated was measured (Test 6). The measurement conditions and the measurement locations of the surface temperature of the photosensitive drum 14 were the same as those employed in Tests 1 and 2. The test results are shown in FIG. 15.

Figure 15:
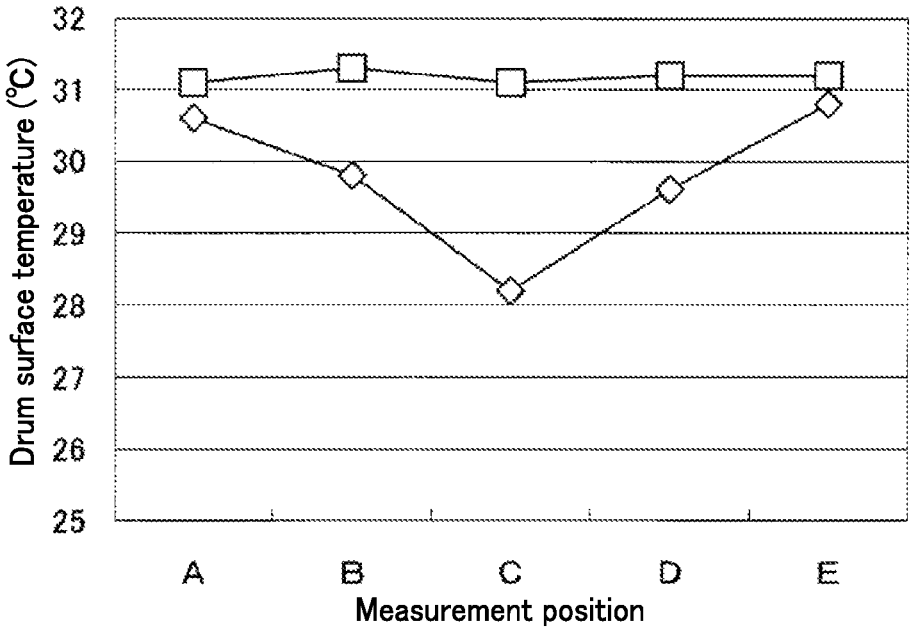
FIG. 15 is a graph showing measurement results of Tests 5 and 6.

In FIG. 15, a data sequence plotted with the symbol □ (white square) indicates the results of Test 5, whereas a data sequence plotted with the symbol ◇ (white diamond) indicates the result of Test 6. As FIG. 15 clarifies, the surface temperature of the photosensitive drum 14 in Test 5 (the data sequence with □ (white square)) was 31° C. at all the measurement locations A-E. This confirms that by setting the resistance values to be gradually higher from the edge portions of the substrate 53*a* (11Ω) toward the central portion of the substrate 53*a* (13Ω), the photosensitive drum 14 was heated uniformly across its longitudinal direction. In contrast, Test 6 (the data sequence with ◇ (white diamond)) indicates that the surface temperature of the photosensitive drum 14 was gradually lower from the edge portions of the photosensitive drum 14 toward the central portion of the photosensitive drum 14 to fall below the target temperature of 31° C. as a result of providing the resistor chips 53*b* all having the same resistance value (11Ω).

In addition, the value of the electric current flowing through the heating element 53 of the image forming apparatus 100 was 0.0857 A in Example 3. In addition, the value of the electric current flowing through the heating element 53 of the image forming apparatus 100 was 0.0909 A in Comparative Example 3. It follows that the power consumption W of the heating element 53 of Example 3 is calculated to be $W=I^2R=(0.0857)^2\times\{(11\times12)+(12\times8)+(13\times4)\}=(0.0857)^2\times280\approx2.056$ W. On the other hand, the power consumption W of the heating element 53 of Comparative Example 3 is calculated to be $W=I^2R=(0.0909)^2\times(11\times24)\approx2.181$ W. It means that there was no substantial difference in the power consumption between the image forming apparatus 100 of Example 3 and the image forming apparatus 100 of Comparative Example 3.

Each test described above confirms the effect achieved by adjusting the resistance values of the resistor chip 53*b* to ensure a uniform temperature distribution of the photosensitive drum 14 across the longitudinal direction of the photosensitive drum 14. That is, the temperature variations of the photosensitive drum 14 across the longitudinal direction of the photosensitive drum 14 were eliminated and thus occurrence of image deletion was effectively reduced. Although not disclosed herein, it is confirmed that the uniform temperature distribution of the photosensitive drum 14 across the longitudinal direction of the photosensitive drum 14 can also be achieved by changing the spacing intervals of the resistor chips 53*b* mounted on the substrate 53*a*.

What is claimed is:

1. An image forming apparatus comprising:

an image bearing member including a photosensitive layer;

a developing unit configured to form a toner image by supplying a developing agent containing toner to the image bearing member to cause the toner to adhere to a surface of the image bearing member in conformity with an electrostatic latent image formed on the image bearing member;

a cleaning unit configured to remove residual toner from the surface of the image bearing member;

a heating element configured to heat the image bearing member, the heating element including a substrate having a length corresponding to an entire region of the image bearing member in a longitudinal direction of the image bearing member, and a plurality of resistor chips spaced on the substrate in a longitudinal direction of the substrate such that at least either resistance values or spacing intervals of the resistor chips vary in the longitudinal direction of the substrate, thereby causing the image bearing member to have a uniform temperature distribution when heated by the heating element.

2. An image forming apparatus according to claim 1, further comprising:

a transfer member configured to transfer the toner image formed on the surface of the image bearing member by the developing unit to a recording medium; and a recording medium conveyance path disposed between the transfer member and the image bearing member such that the recording medium is conveyed therethrough, the recording medium conveyance path including a resin member forming a conveyance surface, the resin member having a concave portion at a location closer to the transfer member than to the image bearing member, wherein the heating element is accommodated in the concave portion and located downstream from a contact point between the image bearing member and the transfer member in a conveyance direction in which the recording medium is conveyed through the recording medium conveyance path, and the developing unit is located upstream from the contact point between the image bearing member and the transfer member in the conveyance direction of the recording medium.

3. An image forming apparatus according to claim 2, wherein the plurality of resistor chips are mounted exclusively on one main surface of the substrate, and the heating element is disposed such that the substrate has the one main surface facing the image bearing member or the transfer member and another main surface facing away from the image bearing member or the transfer member.

4. An image forming apparatus according to claim 3, wherein the heating element is disposed at a location that the substrate is projected on the surface of the image bearing member.

5. An image forming apparatus according to claim 2, wherein the substrate is made from a material having a thermal conductivity equal to or lower than a thermal conductivity of the resin member.

6. An image forming apparatus according to claim 2, wherein the resin member has a relative temperature index that is higher than a surface temperature of the heating element during heating.

7. An image forming apparatus according to claim 3, further comprising a conveyance metal plate extending from an inner wall surface of the concave portion to a location downstream in the conveyance direction of the recording medium along an upper surface of the resin member, wherein the other surface of the substrate is secured to the conveyance metal plate.

8. An image forming apparatus according to claim 7, wherein the conveyance metal plate has a thermal conductivity that is higher than both a thermal conductivity of the substrate and a thermal conductivity of the resin member.

9. An image forming apparatus according to claim 7, further comprising a rib disposed on the upper surface of the resin member, the rib protruding beyond a surface of the conveyance metal plate.

10. An image forming apparatus according to claim 2, further comprising a fixing unit that includes a heating member configured to generate heat upon conducting an electric current, and a pressure member pressed against the heating member at a predetermined pressure, the fixing unit being configured to perform fixing of the toner image transferred to the recording medium by the transfer member when the recording medium passes through a nip portion formed between the heating member and the pressure member, wherein when the heating member is conducting an electric current, conduction of electric current to the heating element is turned off, and when the heating member is not conducting an electric current, conduction of the electric current to the heating element is turned on.

11. An image forming apparatus according to claim 1, wherein the cleaning unit includes a polishing member that is pressed against the surface of the image bearing member at a predetermined pressure and configured to polish the surface of the image bearing member, and upon power-up of a main body of the image forming apparatus, the developing unit supplies a developing agent to the image bearing member, and the polishing member polishes the surface of the image bearing member.

* * * * *